US006267690B1

(12) United States Patent
Salmon

(10) Patent No.: US 6,267,690 B1
(45) Date of Patent: Jul. 31, 2001

(54) GOLF CLUB HEAD WITH CORRECTIVE CONFIGURATION

(76) Inventor: Marc Salmon, 1931 Arthur Buies, Montréal, Québec (CA), H1L 3G5

( * ) Notice: Subject to any disclaimer, the term of this patent is extended or adjusted under 35 U.S.C. 154(b) by 0 days.

(21) Appl. No.: 09/247,046

(22) Filed: Feb. 9, 1999

(30) Foreign Application Priority Data

Feb. 17, 1998 (GB) ..... 9803262

(51) Int. Cl.[7] ..... A63B 53/04
(52) U.S. Cl. ..... 473/325; 473/330
(58) Field of Search ..... 473/330, 324, 473/325, 331

(56) References Cited

U.S. PATENT DOCUMENTS 1,211,708 * 1/1917 Hudson .
1,467,714 * 9/1923 Doerr .
1,540,550 * 6/1925 East .
1,647,487 * 11/1927 Vernon .
1,673,994 * 6/1928 Quynn .
1,674,173 * 6/1928 Haupt .
2,472,978 * 6/1949 Mahon .
2,826,417 * 3/1958 Marcoccio .
3,720,410 * 3/1973 Saytar .
4,413,825 * 11/1983 Sasse .
4,508,349 * 4/1985 Gebauer .
4,523,758 * 6/1985 Guendling, Jr. .
6,062,987 * 5/2000 Woodward .

FOREIGN PATENT DOCUMENTS

2300815 * 11/1996 (GB) .

* cited by examiner

*Primary Examiner*—Jeanette Chapman
*Assistant Examiner*—Stephen L. Blau

(57) ABSTRACT

A golf club which comprises a shaft and an improved club head, the club head having a toe portion, a heel portion, a sole, a front face defined by a bottom edge adjacent the sole, a heel side edge and a toe side edge adjacent the heel and toe portions respectively, and a top edge, the front face having a recessed portion extending substantially between the heel side edge and the toe side edge. The recessed portion may have various configurations from concave to the combination of different planar surfaces.

12 Claims, 3 Drawing Sheets

GOLF CLUB HEAD WITH CORRECTIVE CONFIGURATION

BACKGROUND OF THE INVENTION

The present invention relates to golf equipment and more particularly, relates to a novel golf club head designed to impart spin to a ball.

The field of golf clubs is replete with many structures designed to improve or render easier the hitting of a golf ball. Included among the proposals in the art are golf club heads with means for imparting a corrective spin or action to a golf ball when struck by the golf club. Thus, for example, U.S. Pat. No. 5,354,059 issued to Alfred O. Stuss, Oct. 11, 1994, discloses a golf club head having plural grooves extending along their face in at least two nonparallel directions for the purpose of achieving a variety of different corrective actions to golf balls struck by the face of the club. The grooves are more specifically adapted to control backspin and skidding and also to compensate for toe and heel shots. U.S. Pat. No. 5,090,703 issued to Angelo Koumarianos, Feb. 25, 1992, discloses a golf club in which the ball engaging face of the club head has a rectangular central opening through which sand can pass during a stroke while the club is used as a sand wedge. Upper and lower flat rim surfaces are dimensioned, angled and spaced so as to contact the golf club at intermediate portions between the outer and inner edges of the rim surfaces. U.S. Pat. No. 4,165,076 issued to Richard Cella, Aug. 21, 1969, discloses a golf club having a blade face formed with a longitudinal edge which has a normal ball striking component of the golf club located above the center line of the ball in blade striking position and is thus capable on proper alignment with the ball of causing the latter to roll with minimal deviation towards its target. On the reverse side of the blade there is provided a secondary ball striking edge located below the center line of the ball.

Many of the prior art structures are directed specifically towards a putter type of club to be used on or around the green. As will be appreciated, it is desirable to provide a golf club wherein the risk of hooking or slicing the golf ball is minimized and particularly when used by the average golfer.

SUMMARY OF THE INVENTION

It is therefore an object of the present invention to provide a golf club which provides a desired spin to the golf ball when struck thereby.

It is a further object of the present invention to provide an improved golf club head which may be utilized to impart backspin to the ball.

According to one aspect of the present invention, there is provided a golf club which comprises a shaft and a club head, the club head having a toe portion, a heel portion, a sole, a front face defined by a bottom edge adjacent to the sole, first and second side edges adjacent the heel and toe portions respectively of the club head, and a top edge, the front face having a recessed portion extending substantially between the first and second side edges.

In a further aspect of the present invention, there is provided a golf club comprising a shaft and a club head, the club head having a toe portion, a heel portion, a sole, a front face defined by a bottom edge adjacent the sole, a heel side edge and a toe side edge adjacent the heel and toe portions respectively of the club head, and a top edge, the front face having a recessed portion defined by a first front face portion extending rearwardly from a position proximate the sole towards the back face with respect to a plane extending between the sole and the top edge, and a second front face portion extending rearwardly from a position proximate the top edge towards the back face with respect to the plane, the front face having a protuberance extending substantially parallel to the sole, the protuberance having a generally convex configuration and being located proximate the top edge, the protuberance extending substantially between the heel side edge and the toe side edge.

The golf club of the present invention may take any conventional form and method of manufacture insofar as the connection between the club head and the shaft. The unique features lie in the particular configuration of the front face of the club head. As such, there may be provided conventional means for securing the club head to a shaft by means of a suitable hosel and the shaft may be formed of any suitable material such as graphite, stainless steel, etc. A suitable handle may be provided on the end of the shaft as is conventional.

Similarly, the front face may be provided with suitable friction imparting means such as relatively small grooves and/or a rough surface on the face.

Although the front face may take various configurations in terms of the overall size and shape, the front face is preferably of a generally conventional outline. It is, however, preferred that the front face be sized such that the ball will complete close to a full rotation on the front face. As such, it would have a surface length approximating at least the circumference of a golf ball which is normally approximately 44 mm. Thus, a surface height of between 35–55 mm would be appropriate.

BRIEF DESCRIPTION OF THE DRAWINGS

Having thus generally described the invention, reference will be made to the accompanying drawings illustrating embodiments thereof, in which.

DESCRIPTION OF THE PREFERRED EMBODIMENTS

Figure 1:
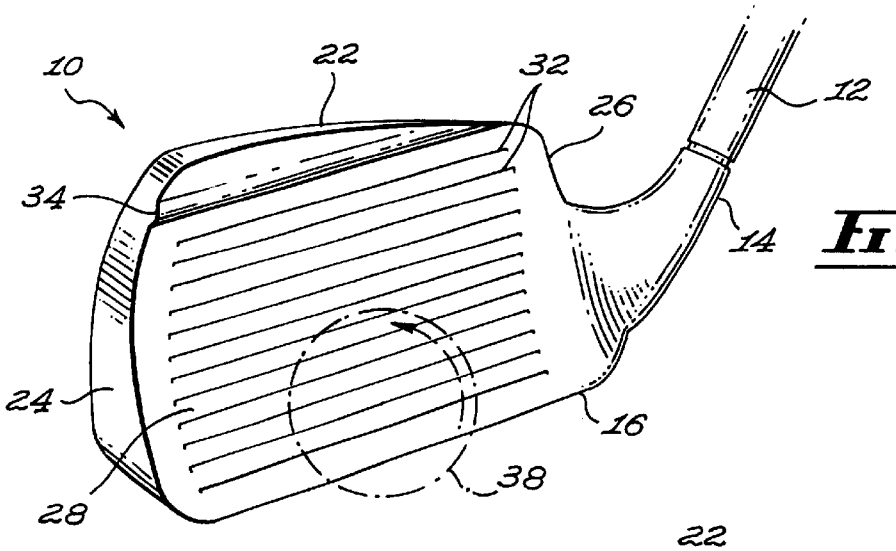
FIG. 1 is a perspective view of a golf club head according to the present invention.

Referring to the drawings in greater detail and by reference characters thereto, there is illustrated in FIG. 1 a golf club head generally designated by reference numeral 10 and which golf club bead 10 is connected to a shaft 12 by means of a hosel 14 in a substantially conventional manner.

Golf club head 10 includes a bottom sole 16 which extends between the club head toe generally designated by reference numeral 18 and the club head heel generally designated by reference numeral 20. Club head 10 also includes a top edge 22, a side edge 24 at toe 18 and a side edge 26 at heel 20.

Club head 10 also has a front face generally designated by reference numeral 28 and a back face 30. Front face 28 includes a plurality of grooves 32 in a substantially conventional arrangement.

Figure 3:
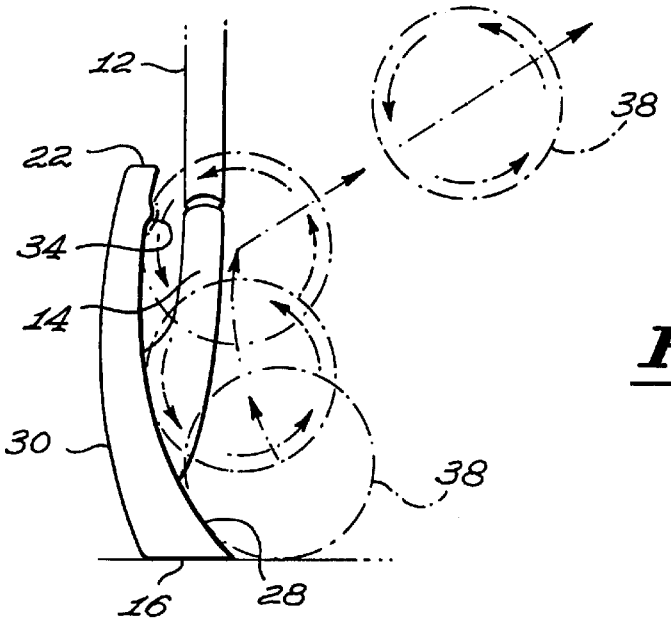
FIG. 3 is a side elevational view of the golf club head illustrating the motion imparted to a golf ball upon impact with the club head.

Front face 28, as may be best seen in FIG. 3, has a recessed portion which extends inwardly towards back face 30 with respect to a plane extending between top edge 22 and sole 16. In the illustrated embodiment of FIG. 3, the recessed portion is of a generally concave configuration.

Figure 2:
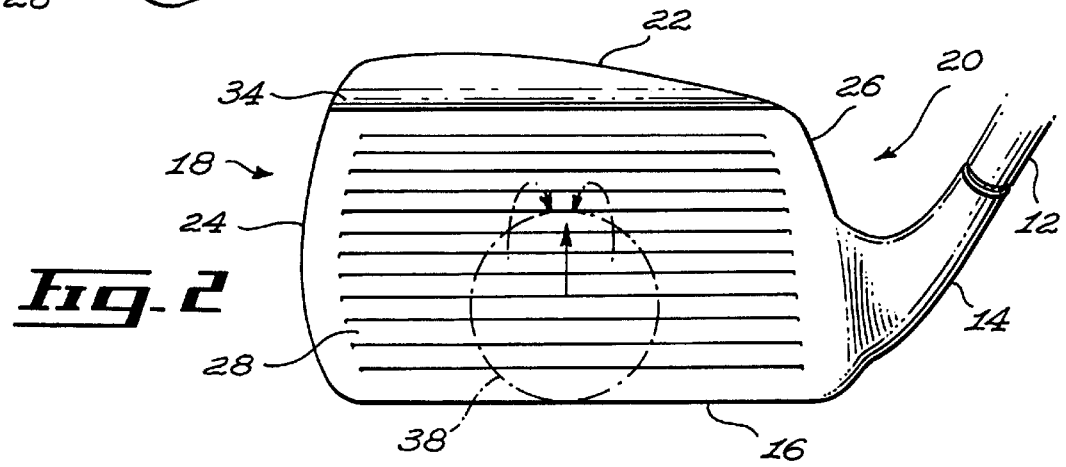
FIG. 2 is a front elevational view thereof.

In the embodiment of FIGS. 1 to 3, there is provided a protuberance 34 which is of a generally convex configuration and which is located proximate top edge 22 and extends in a line generally parallel to sole 16. Protuberance 34 extends from toe side edge 24 to a point proximate heel side edge 26.

In use, a golf ball 38, as best seen in FIG. 3, when hit in a conventional manner with club head 10 such that a lower portion of front face 28 contacts golf ball 38, will cause golf ball 38 to <<roll up>> front face 28 and due to the grooves 32 and/or other conventional friction creating means, will impart a spin as indicated by arrows 36. It will be noted that as golf ball 38 reaches a point adjacent top edge 22, it will contact protuberance 34 which will further accelerate the rotation of golf ball 38 prior to its separation from club head 10.

As previously mentioned, the distance between sole 16 and top edge 22 preferably approximates the circumference of a golf ball—i.e. approximately 44 mm. As will be seen from FIG. 3, the spin imparted to the golf ball is that normally referred to as <<backspin>> which normally implies that the ball will attain a greater height and stop relatively quickly upon impact with the ground.

Various configurations for the recessed portion are possible and reference will now be made to FIGS. 4 to 15 illustrating some of the possible embodiments according to the present invention.

Figure 4:
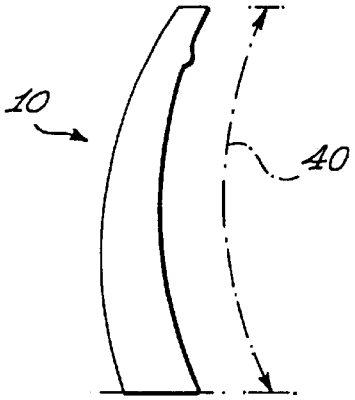
FIG. 4 is a side elevational view of a left-hand golf club according to the present invention having a configuration similar to that of the right-hand golf club head of FIGS. 1 to 3.

In FIG. 4, there is illustrated a club head 10 which is of a left-hand configuration, but otherwise identical to that shown in FIGS. 1 to 3. As shown in this figure, front face 28 is of a concave outline and has a curvature as indicated by arrow 40 which is of a substantially uniform radius.

Figure 5:
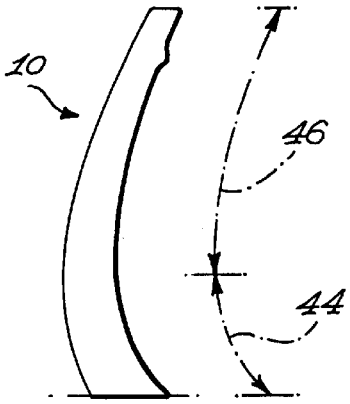
FIG. 5 is a side elevational view of a left-hand golf club having a modified recessed portion on the front face thereof.

In the embodiment of FIG. 5, front face 28 has a first lower arcuate segment indicated by arrow 44 which is of a first radius and a second upper arcuate segment indicated by arrow 46 of a differing larger radius compared to the lower segment.

Figure 6:
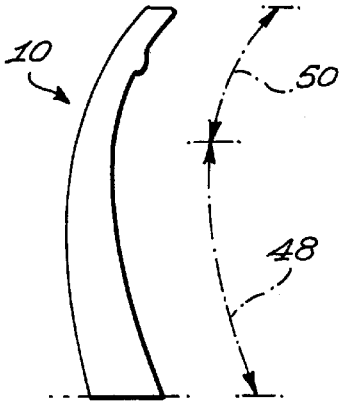
FIG. 6 is a side elevational view of a further embodiment of a recessed portion on the front face of the club head.

In the embodiment of FIG. 6, golf club head 10 has a recessed portion which is opposite to that shown in FIG. 5—i.e. there is a first lower arcuate segment indicated by arrow 48 having a larger radius compared to a second lower arcuate segment indicated by arrow 50 which has a smaller radius.

Figure 7:
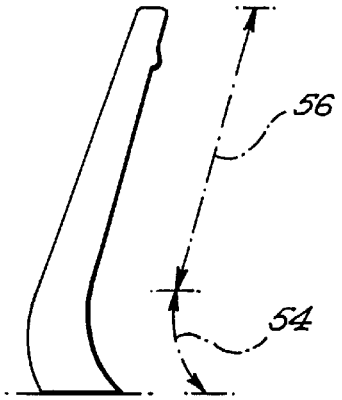
FIG. 7 is a side elevational view of a further embodiment of a recessed portion on the front face of the club head.

In the embodiment illustrated in FIG. 7, golf club head 10 has a lower arcuate segment indicated by arrow 54 which connects to an upper straight or flat segment indicated by arrow 56.

Figure 8:
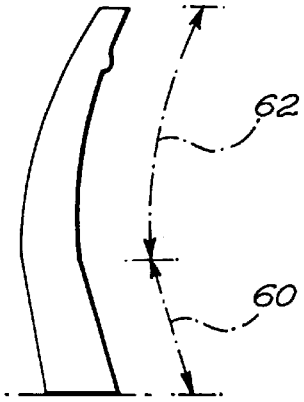
FIG. 8 is a side elevational view of a further embodiment of a recessed portion on the front face of the club head.

In the embodiment of FIG. 8, golf club head 10 has a lower straight segment shown by arrow 60 which merges with an arcuate upper segment indicated by arrow 62.

Figure 9:
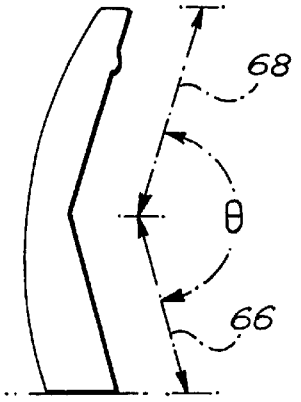
FIG. 9 is a side elevational view of a further embodiment of a recessed portion on the front face of the club head.
Figure 10:
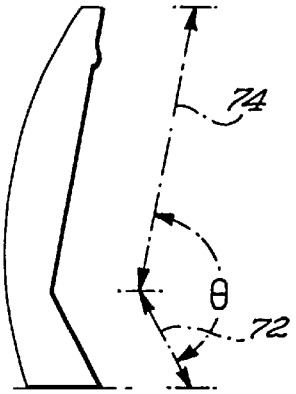
FIG. 10 is a side elevational view of a further embodiment of a recessed portion on the front face of the club head.

FIG. 9 illustrates an embodiment wherein golf club head 10 has a lower straight segment indicated by arrow 66 which connects to an upper straight segment indicated by arrow 68, with the angles between the segments being designated by angle. In the embodiment of FIG. 10, golf club head 10 has a lower relatively short straight or flat segment indicated by arrow 72 and an upper relatively long straight or flat segment indicated by arrow 74.

Figure 11:
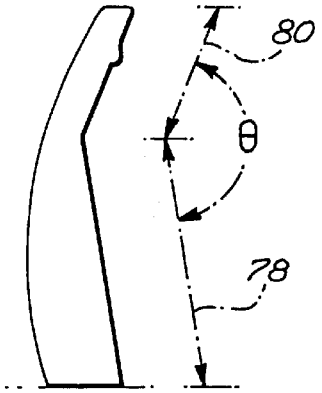
FIG. 11 is a side elevational view of a further embodiment of a recessed portion on the front face of the club head.

FIG. 11 illustrates a reverse embodiment to that shown in FIG. 10—there is provided a lower relatively long straight segment indicated by arrow 78 and a shorter upper straight or flat segment indicated by arrow 80.

Figure 12:
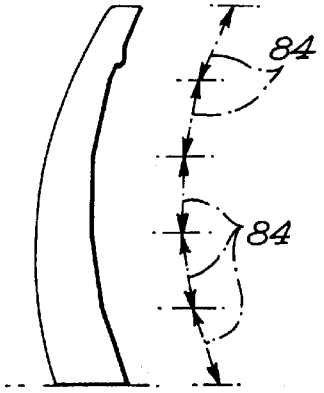
FIG. 12 is a side elevational view of a further embodiment of a recessed portion on the front face of the club head.

FIG. 12 illustrates an embodiment wherein golf club head 10 has a front face 28 which is formed of five straight or flat segments 84, each segment 84 being of a substantially identical height.

Figure 13:
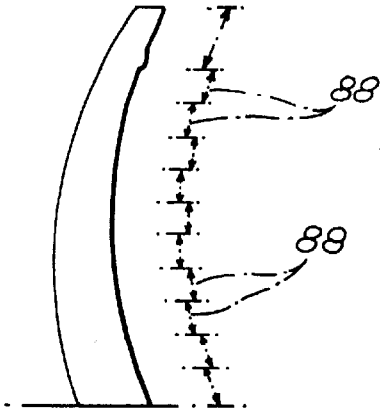
FIG. 13 is a side elevational view of a further embodiment of a recessed portion on the front face of the club head.

In FIG. 13, the arrangement is similar to that of FIG. 12 in that golf club head 10 has a front face 28 defined by ten relatively short straight or flat segments 88 when the segments become small enough, this configuration approaches the concave configuration previously described in FIG. 4.

Figure 14:
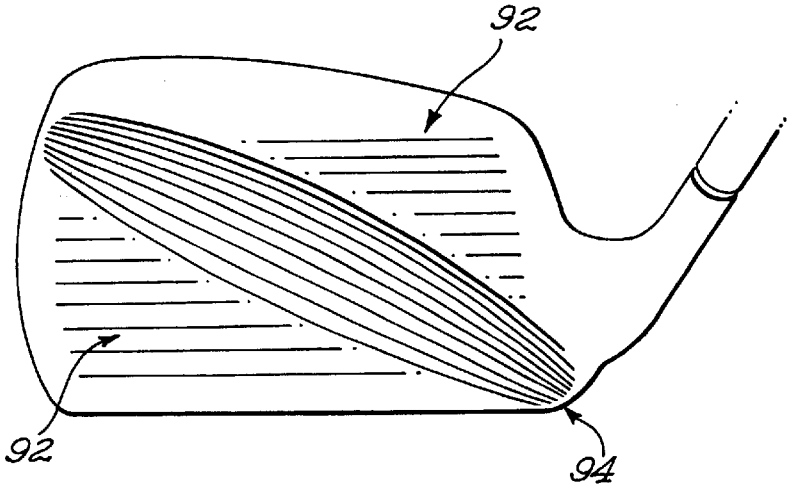
FIG. 14 is a front elevational view of a still further embodiment of a golf club head according to the present invention.
Figure 15:
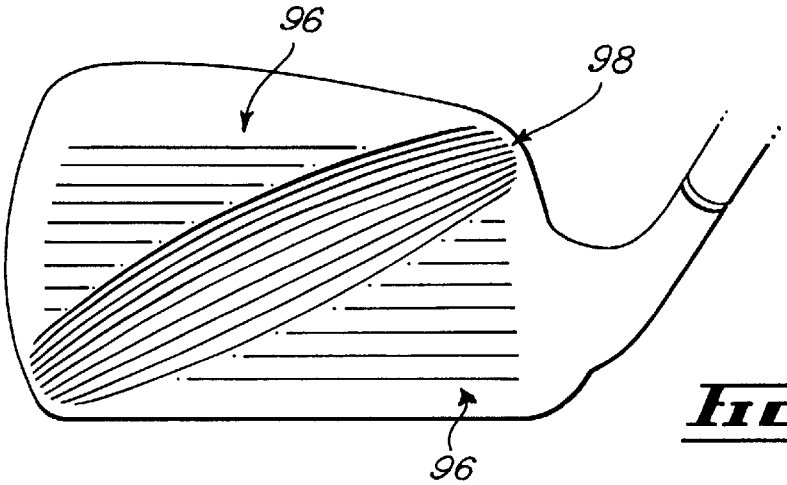
FIG. 15 is a front elevational view of a still further embodiment of a golf club head according to the present invention.

Variations of the above embodiments are illustrated in FIGS. 14 and 15. In the embodiment of FIG. 14, there is provided a pair of triangularly shaped flat sections 92 divided by a concave portion 94 which extends diagonally across front face 28 of golf club head 10 from proximate the point of juncture of sole 16 and heel side edge 26 to a point proximate the point of juncture of top edge 22 and toe side edge 24.

The reverse configuration is illustrated in FIG. 15 wherein flat sections 96 are separated by a concave portion 98 which extends diagonally upwardly from proximate the point of juncture of toe side edge 24 and sole 16 to proximate the point of juncture of top edge 22 and heel side edge 26.

It will be seen from the above that many different arrangements are possible to provide a recessed portion within front face 28. These embodiments are intended for illustration of the possibilities and it will be understood that further modifications may be made thereto without departing from the spirit and scope of the invention.

I claim:

1. A golf club comprising a shaft and a club head, said club head having a toe portion, a heel portion, a planar sole, a back face a front face defined by a bottom edge adjacent said sole,a heel side edge and a toe side edge adjacent said heel and toe portions respectively of said club head, and a top edge, said front face having a recessed portion extending substantially between said heel side edge and said toe side edge, only one protuberance on said front face and extending outwardly therefrom, said protuberance extending substantially parallel to said sole and being located proximate said top edge, said protuberance having a generally convex configuration and a hosel connecting said shaft to said club head.

2. The golf club of claim 1 wherein said recessed portion has a generally concave configuration.

3. The golf club of claim 2 wherein said concave configuration of said recessed portion has a substantially constant radius of curvature.

4. The golf club of claim 2 wherein said concave configuration of said recessed portion is defined by a plurality of concave segments each having a different radius.

5. The golf club of claim 1 wherein said recessed portion is defined by a first front face portion extending rearwardly from a position proximate said sole towards said back face with respect to a plane extending between said sole and said top edge, and a second front face portion extending rearwardly from a position proximate said top edge towards said back face with respect to said plane.

6. The golf club of claim 5 wherein said first front face portion has a generally concave configuration and said second front face portion has a generally concave configuration, said concave configuration of said first front face portion having a radius different than a radius of said concave configuration of said second front face portion.

7. The golf club of claim 6 wherein said concave first front face portion has a larger radius than said radius of said concave second front face portion.

8. The golf club of claim 6 wherein said radius of said concave first front face portion is smaller than said radius of said concave second front face portion.

9. The golf club of claim 5 wherein said first front face portion has a generally concave configuration and said second front face portion is of a substantially planar configuration.

10. The golf club of claim 5 wherein said first front face portion is of a generally planar configuration and said second front face portion is of a concave configuration.

11. The golf club of claim 5 wherein each of said first front face portion and said second front face portion have a generally planar configuration.

12. A golf club comprising a shaft and a club head, said club head having a toe portion, a heel portion, planner a sole, a front face, a back face defined by a bottom edge adjacent said sole, a heel side edge and a toe side edge adjacent said heel and toe portions respectively of said club head, and a top edge, said front face having a recessed portion defined by a first front face portion extending rearwardly from a position proximate said sole towards said back face with respect to a plane extending between said sole and said top edge, and a second front face portion extending rearwardly from a position proximate said top edge towards said back face with respect to said plane, said front face having only one protuberance extending substantially parallel to said sole, said protuberance having a generally convex configuration and being located proximate said top edge, said protuberance extending substantially between said heel side edge and said toe side edge and a hosel connecting said shaft to said club head.

* * * * *